US009943902B2

(12) United States Patent
Hyun et al.

(10) Patent No.: US 9,943,902 B2
(45) Date of Patent: Apr. 17, 2018

(54) FORGING DIE APPARATUS

(71) Applicant: Hyundai Motor Company, Seoul (KR)

(72) Inventors: Sung Dae Hyun, Daegu (KR); Jae Hyung Kwon, Ulsan (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 15/182,426

(22) Filed: Jun. 14, 2016

(65) Prior Publication Data

US 2017/0100768 A1 Apr. 13, 2017

(30) Foreign Application Priority Data

Oct. 13, 2015 (KR) ..... 10-2015-0143112

(51) Int. Cl.
*B21J 9/02* (2006.01)

(52) U.S. Cl.
CPC ..... *B21J 9/02* (2013.01)

(58) Field of Classification Search
CPC ..... B21J 9/00; B21J 9/02; B21J 13/04; B21D 24/06; B21D 37/04; B21D 37/02
USPC ..... 72/355.2, 360, 353.3
See application file for complete search history.

(56) References Cited

U.S. PATENT DOCUMENTS 4,187,713 A * 2/1980 Fellner ..... B21J 13/03 72/446
5,297,719 A 3/1994 Cremerius
7,134,312 B2 * 11/2006 Yamanaka ..... B21D 37/14 72/446

FOREIGN PATENT DOCUMENTS

JP 60-223632 A 8/1985
JP 2000-301277 A 10/2000
JP 2003-181569 A 7/2003
JP 2004-290992 A 10/2004
KR 10-1999-0041537 A 6/1999

* cited by examiner

*Primary Examiner* — Teresa M Ekiert
(74) *Attorney, Agent, or Firm* — Mintz Levin Cohn Ferris Glovsky and Popeo, P.C.; Peter F. Corless

(57) ABSTRACT

A forging die apparatus includes: an upper mold holder installed to be movable in a vertical direction, an upper mold detachably installed in the upper mold holder, a lower mold holder installed to be movable in the vertical direction, a lower mold detachably installed in the lower mold holder, and a stopper unit detachably installed in one of the upper mold holder and the lower mold holder to selectively restrain the vertical movement of the one of the upper mold holder and the lower mold holder in which the stopper unit is installed.

9 Claims, 5 Drawing Sheets

<RELATED ART>

<RELATED ART>

FORGING DIE APPARATUS

CROSS-REFERENCE TO RELATED APPLICATION

This application claims the benefit of and priority to Korean Patent Application No. 10-2015-0143112, filed on Oct. 13, 2015, in the Korean Intellectual Property Office, the disclosure of which is incorporated herein in its entirety by reference.

TECHNICAL FIELD

The present disclosure relates generally to a forging die apparatus for forging an inner race for a constant-velocity joint, and more particularly, to a forging die apparatus for forging an inner race for different types of a constant-velocity joint through a common structure.

BACKGROUND

As is widely known, constant-velocity joints maintain a rotational speed of an engine transmission at the same speed as that of a wheel, and even though power transmission between a transmission and a tire and an operation angle are changed, constant-velocity joints may transmit uniform rotation and torque. Constant-velocity joints include for instance, a tripod joint, a double offset joint, a cross-groove joint, a Rzeppa joint, and a Birfield joint.

Among these joints, the Birfield joint installed at a wheel side and the tripod joint installed at a transmission side are commonly used. Constant-velocity joints may also include an inner race and an outer race, and in particular, inner races may be formed to be different according to types thereof.

In this regard, FIG. 1(RELATED ART) is a view illustrating an inner race 5 of a tripod joint, in which the inner race 5 has a vertically symmetrical shape, and FIG. 2(RELATED ART) is a view illustrating an inner race 6 of a Birfield joint, in which the inner race 6 of the Birfield joint has a vertically asymmetrical shape.

In this manner, since inner races of constant-velocity joints have different structures according to varying types thereof, the inner races are molded by respective dedicated forging dies. Thus, since dedicated molds should be separately prepared according to types, high manufacturing costs may be incurred. In addition, separate storage places for dedicated molds for the varying types of components may be wasted, further contributing to increased manufacturing costs.

SUMMARY

The present disclosure has been made to solve the above-mentioned problems occurring in the related art while advantages achieved by the related art are maintained intact.

An aspect of the present disclosure provides a forging die apparatus capable of forging inner races for different types of constant-velocity joints through a common structure, thus significantly reducing manufacturing costs, improving production flexibility, and minimizing the use of storage places and adjunctive components.

According to embodiments of the present disclosure, a forging die apparatus includes: an upper mold holder installed to be movable in a vertical direction; an upper mold detachably attached to the upper mold holder; a lower mold holder installed to be movable in the vertical direction; a lower mold detachably attached to the lower mold holder;

and a stopper unit detachably attached to one of the upper mold holder and the lower mold holder to selectively restrain the vertical movement of the one of the upper mold holder and the lower mold holder in which the stopper unit is installed.

An upper plate may be disposed above the upper mold holder, and the upper mold holder may vertically move with respect to the upper plate.

A lower plate may be disposed below the lower mold holder, and the lower mold holder may vertically move with respect to the lower plate.

The stopper unit may include a stopper block configured to restrain vertical movement of the upper mold holder.

The stopper block may be installed to penetrate through the upper mold holder and disposed such that an upper surface of the stopper block is in contact with a lower surface of an upper plate disposed above the upper mold holder and a lower surface of the stopper block is adjacent to the upper mold.

The stopper unit may further include a first correction block interposed between the upper mold and the stopper block.

The stopper unit may further include a second correction block disposed on a lower surface of the lower mold.

Furthermore, according to embodiments of the present disclosure, a forging die apparatus includes: an upper mold holder installed to be movable in a vertical direction; an upper mold detachably attached to the upper mold holder; a lower mold holder installed to be movable in a vertical direction; a lower mold detachably attached to the lower mold holder; an upper guide mold disposed on an upper surface of the upper mold and configured to guide an upper knock-out punch; a lower guide mold disposed on a lower surface of the lower mold and configured to guide a lower knock-out punch; and a stopper block detachably installed in the upper mold holder to selectively replace the upper guide block and restrain the movement of the upper mold holder.

An upper plate may be installed above the upper mold holder, and one or more upper springs may be installed between the upper mold holder and the upper plate.

A lower plate may be installed below the lower mold holder, and one or more lower springs may be installed between the lower mold holder and the lower plate.

A length of the stopper block may be equal to a sum of a maximum elongated length of the one or more upper springs and a thickness of the upper mold holder.

BRIEF DESCRIPTION OF THE DRAWINGS

The above and other objects, features and advantages of the present disclosure will be more apparent from the following detailed description taken in conjunction with the accompanying drawings.

Figure 1:
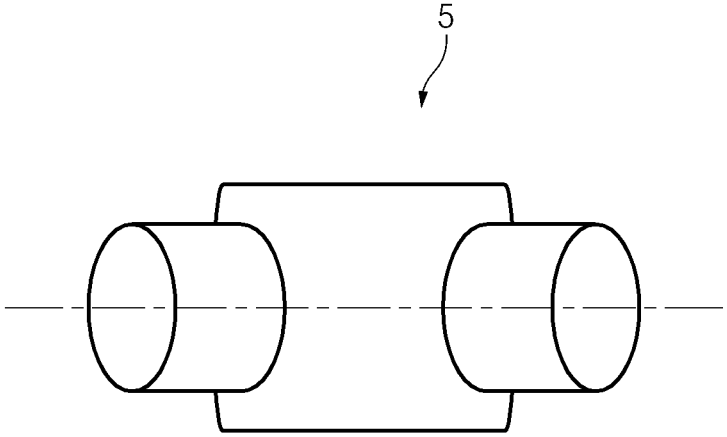
FIG. 1(RELATED ART) is a side view illustrating an inner race of a tripod joint.
Figure 2:
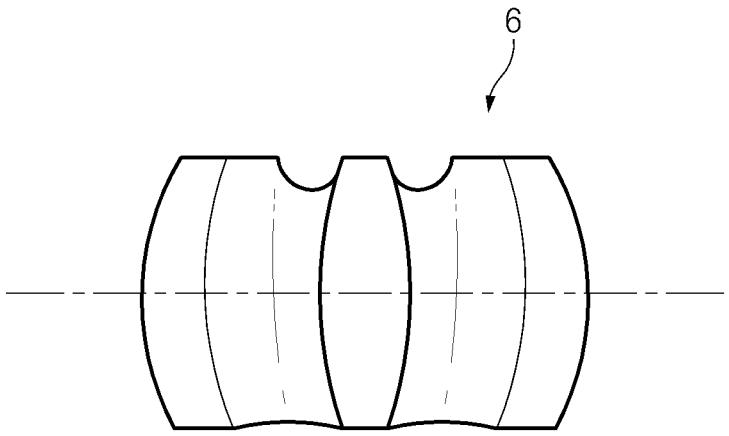
FIG. 2(RELATED ART) is a side view illustrating an inner race of a Birfield joint.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF THE EMBODIMENTS

Hereinafter, embodiments of the present disclosure will be described in detail with reference to the accompanying drawings. For reference, dimensions of elements or thicknesses of lines illustrated in the drawings referred to describe the present disclosure may be exaggerated for the convenience of understanding. Also, the terms used henceforth have been defined in consideration of the functions of the present disclosure, and may be altered according to the intent of a user or operator, or conventional practice. Therefore, the terms should be defined on the basis of the entire content of this specification.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Figure 3:
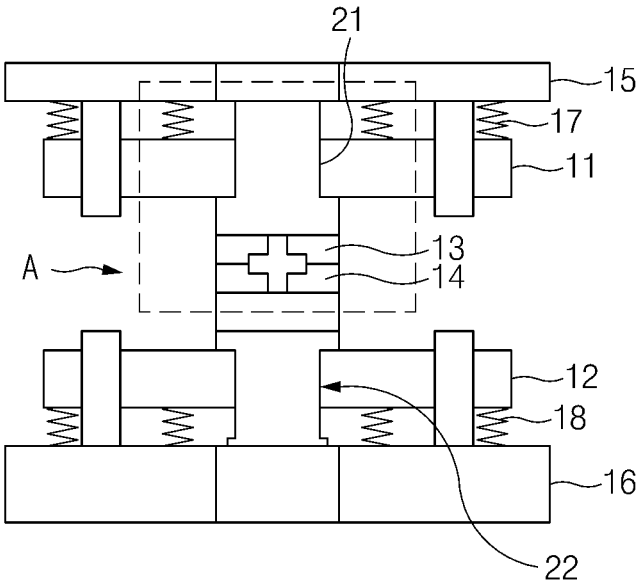
FIG. 3 is a view illustrating a forging die apparatus according to embodiments of the present disclosure.

Referring now to the presently disclosed embodiments, FIG. 3 illustrates a forging die apparatus according to embodiments of the present disclosure. The forging die apparatus may include an upper mold holder 11 installed to be movable in a vertical direction, an upper mold 13 detachably attached to the upper mold holder 11, a lower mold holder 12 installed to be movable in the vertical direction, and a lower mold 14 detachably attached to the lower mold holder 12.

An upper plate 15 is disposed above the upper mold holder 11, and the upper mold holder 11 may be installed to be movable in a vertical direction with respect to the upper plate 15. The upper mold holder 11 may be installed to be movable in the vertical direction from a lower surface of the upper plate 15 by a hydraulic system, for example.

An upper spring 17 may be installed between the upper mold holder 11 and the upper plate 15. The upper mold 13 may be detachably installed on a lower surface of the upper mold holder 11.

A lower plate 16 may be disposed below the lower mold holder 12, and the lower mold holder 12 may be installed to be movable in the vertical direction with respect to the lower plate 16. The lower mold holder 12 may be installed to be movable in a vertical direction from an upper surface of the lower plate 16 by a hydraulic system, for example.

A lower spring 18 may be installed between the lower mold holder 12 and the lower plate 16. The upper mold 13 may have upper cavities 23*a* and 23*b* for forming an inner race for a constant-velocity joint therein.

As the upper mold 13, any one of a first upper mold 13*a* (e.g., see FIG. 4) having a first upper cavity 23*a* and a second upper mold 13*b* (e.g., see FIG. 5) having a second upper cavity 23*b* may be selectively used. Further, the lower mold 14, any one of a first lower mold 14*a* (e.g., see FIG. 4) having a first lower cavity 24*a* and a second lower mold 14*b* (e.g., see FIG. 5) having a second lower cavity 24*b* may be selectively used.

Figure 4:
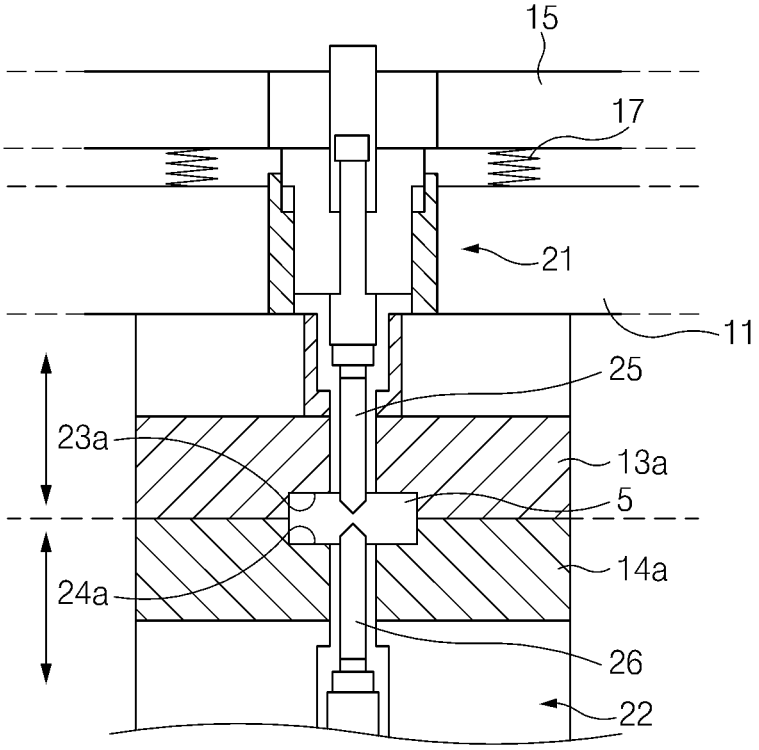
FIG. 4 is an enlarged view of a portion "A" indicated by the arrow in FIG. 3.

As illustrated in FIG. 4, the first upper cavity 23*a* of the first upper mold 13*a* and the first lower cavity 24*a* of the first lower mold 14*a* may be vertically symmetrical, and the upper mold holder 11 and the lower mold holder 12 may be moved in a vertically facing manner. The first upper mold 13*a* and the first lower mold 14*a* may apply forming force in mutually facing directions.

An upper guide block 21 guiding movement of the upper mold holder 11 is installed between the first upper mold 13*a* and the upper plate 15, and here, the upper guide block 21 may be installed through the upper mold holder 11. A knock-out punch 25 may be configured to move vertically at a central portion of the upper guide block 21.

A lower guide block 22 guiding movement of the lower mold holder 12 may be installed between the first lower mold 14*a* and the lower plate 16, and here, the lower guide block 22 may be installed through the lower mold holder 12. A lower knock-out punch 26 may be configured to move vertically at a central portion of the lower guide block 22.

A component having a vertically symmetrical shape such as the inner race 5 (e.g., see FIG. 1) of the tripod joint may be forged by the first upper mold 13*a* and the first lower mold 14*a*.

Figure 5:
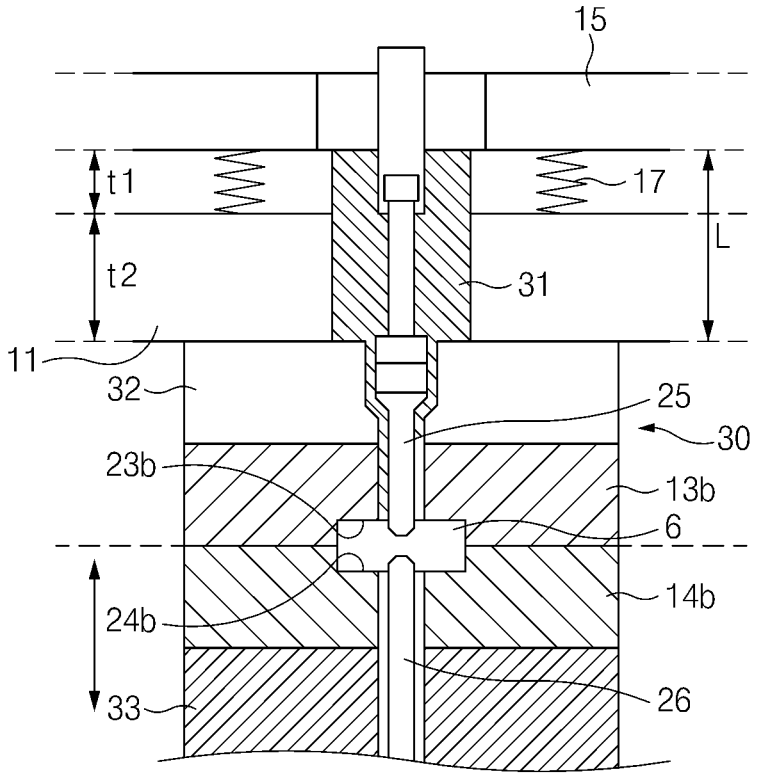
FIG. 5 is a view illustrating a state in which a stopper unit is installed in the place of an upper guide block in FIG. 4.

As illustrated in FIG. 5, in order to form a component having a vertically asymmetrical shape such as the inner race 6 of the Birfield joint, the second upper mold 13*b* and the second lower mold 14*b* may be detachably installed to replace the first upper mold 13*a* and the first lower mold 14*a*. The second upper cavity 23*b* of the second upper mold 13*b* and the second lower cavity 24*b* of the second lower mold 14*b* may have a vertically asymmetrical shape to correspond to the inner race 6 of the Birfield joint.

The forging die apparatus according to embodiments of the present disclosure may further include a stopper unit 30 installed to be selectively detachable in any one of the upper mold holder 11 and the lower mold holder 12, and movement of any one of the upper mold holder 11 and the lower mold holder 12 may be restrained by the stopper unit 30.

As shown in FIG. 5, the stopper unit 30 may be installed in the place of the upper guide block 21, and here, since the stopper unit 30 restrains movement of the upper mold holder 11, movement of the upper mold holder 11 may be stopped, whereby a component having a vertically asymmetrical shape such as the inner race 6 of the Birfield joint may be forged.

The stopper unit 30 may include a stopper block 31 restraining vertical movement of the upper mold holder 11, and here, the stopper block 31 may be installed through the upper mold holder 11. The stopper block 31 may be disposed such that an upper surface thereof is in contact with a lower surface of the upper plate 15 and a lower surface thereof is adjacent to the upper mold 13.

In particular, a length L of the stopper block 31 may be equal to the sum (t1+t2) of a maximum elongated length t1 of the upper spring 17 and a thickness t2 of the upper mold holder 11 (L=t1+t2). Thus, even though the hydraulic system operates, movement of the upper mold holder 11 may be stopped by the stopper block 31.

The stopper unit 30 may further include a first correction block 32 interposed between the second upper mold 13*b* and the stopper block 31. The first correction block 32 may be configured to appropriately correct overall dimensions of the forging die apparatus as the stopper block 31 is installed to replace the upper guide block 21. Also, a second correction block 33 may be installed on a lower surface of the second lower mold 14*b*, whereby overall dimensions of the forging die apparatus according to the substitutive installation of the stopper block 31 may be precisely corrected.

As described above, according to the embodiments of the present disclosure, since inner races for different types of constant-velocity joints are compatibly forged, manufacturing costs may be significantly reduced, production flexibility may be enhanced, and the use of storage places and adjunctive components may be minimized through the common structure.

Hereinabove, although the present disclosure has been described with reference to embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A forging die apparatus comprising:

an upper mold holder installed to be movable in a vertical direction;

an upper mold detachably attached to the upper mold holder;

a lower mold holder installed to be movable in the vertical direction;

a lower mold detachably attached to the lower mold holder; and a stopper unit detachably installed in one of the upper mold holder and the lower mold holder to selectively restrain the vertical movement of the one of the upper mold holder and the lower mold holder in which the stopper unit is installed, wherein a lower plate is disposed below the lower mold holder, and the lower mold holder vertically moves with respect to the lower plate.

2. The forging die apparatus according to claim 1, wherein an upper plate is disposed above the upper mold holder, and the upper mold holder vertically moves with respect to the upper plate.

3. The forging die apparatus according to claim 1, wherein the stopper unit includes a stopper block configured to restrain the vertical movement of the upper mold holder.

4. The forging die apparatus according to claim 3, wherein the stopper block is installed to penetrate through the upper mold holder and disposed such that an upper surface of the stopper block is in contact with a lower surface of an upper plate disposed above the upper mold holder and a lower surface of the stopper block is adjacent to the upper mold.

5. The forging die apparatus according to claim 4, wherein the stopper unit further includes a first correction block interposed between the upper mold and the stopper block.

6. The forging die apparatus according to claim 5, wherein the stopper unit further includes a second correction block disposed on a lower surface of the lower mold.

7. A forging die apparatus comprising:

an upper mold holder installed to be movable in a vertical direction;

an upper mold detachably attached to the upper mold holder;

a lower mold holder installed to be movable in the vertical direction;

a lower mold detachably attached to the lower mold holder;

a lower guide block configured to guide movement of the lower mold holder; and a stopper block detachably attached to the upper mold holder to restrain the movement of the upper mold holder, wherein an upper plate is installed above the upper mold holder, and one or more upper springs are installed between the upper mold holder and the upper plate.

8. The forging die apparatus according to claim 7, wherein a lower plate is installed below the lower mold holder, and one or more lower springs are installed between the lower mold holder and the lower plate.

9. The forging die apparatus according to claim 7, wherein a length of the stopper block is equal to a sum of a maximum elongated length of the one or more upper springs and a thickness of the upper mold holder.

* * * * *